US005436123A

United States Patent [19]

Suzuki

[11] Patent Number: 5,436,123

[45] Date of Patent: Jul. 25, 1995

[54] SILVER HALIDE PHOTOGRAPHIC LIGHT-SENSITIVE MATERIALS

[75] Inventor: Akiko Suzuki, Hino, Japan

[73] Assignee: Konica Corporation, Japan

[21] Appl. No.: 262,280

[22] Filed: Jun. 20, 1994

[30] Foreign Application Priority Data

Jul. 6, 1993 [JP] Japan ..... 5-167056

[51] Int. Cl.[6] ..... G03C 1/76

[52] U.S. Cl. ..... 430/533; 430/496; 430/621; 430/963; 430/435; 430/525

[58] Field of Search ..... 430/533, 621, 496, 963, 430/525, 435

[56] References Cited

U.S. PATENT DOCUMENTS

| | | | |
|---|---|---|---|
| 3,937,754 | 2/1976 | Shimotsuma et al. | 428/480 |
| 4,414,304 | 11/1983 | Dickerson | 430/621 |
| 5,294,473 | 3/1994 | Kawamoto | 430/537 |
| 5,326,689 | 7/1994 | Murayama | 430/533 |

*Primary Examiner*—Thomas R. Neville

*Attorney, Agent, or Firm*—Jordan B. Bierman; Bierman and Muserlian

[57] ABSTRACT

A silver halide photographic light-sensitive material comprises a support and provided thereon, a hydrophilic colloid layer comprising a silver halide emulsion layer, wherein said support has a thickness of 70 to 120 μm and Young's modulus of not less than 550 kg/mm$^2$ and said hydrophilic colloid layer has a degree of swelling of not more than 80%, said degree of swelling being obtained by the following equation:

$$\text{Degree of swelling} = (B - A) \times 100\ A$$

wherein A represents a dry thickness μm of the hydrophilic colloid layer and B represents a thickness μm of the hydrophilic colloid layer after the material was immersed for 15 minutes at 35° C. in developer (b).

10 Claims, No Drawings

SILVER HALIDE PHOTOGRAPHIC LIGHT-SENSITIVE MATERIALS

FIELD OF THE INVENTION

The invention relates to a silver halide photographic light-sensitive material, and particularly to a silver halide photographic light-sensitive material which, even when the material is rapidly processed at high temperature with a developer not lowering the operation conditions, can give an image with high sharpness without deteriorating transportability of the material.

BACKGROUND OF THE INVENTION

A silver halide photographic light-sensitive material for medical use is strongly demanded to give an image with high sharpness, since it is necessary to find fine focuci earlier and diagnose accurately.

In a silver halide photographic light-sensitive material having double sided sensitivity for X-ray use, the undesirable phenomenon called crossover occurs in which a portion of light from the light screen passes through a transparent film support and exposes an emulsion layer on the opposite side of the support. As a result, the sharpness of an image deteriorates. Up to the present, various approaches have been proposed in order to improve this problem.

The crossover is greatly affected by the thickness of the support of the light-sensitive material through which light passes, and the thinner the support, the less the image sharpness deteriorates. However, when the support is thin, there are problems that reduce the mechanical strength of the material and causes poor transportability at rapid processing.

Glutaraldehyde has been used as a hardener in a developer for high temperature development of light-sensitive materials for x-ray use. There are problems that this hardener has a strong irritating odor, which deteriorates the atmosphere of a dark room, and hinders rapid processing. In view of the above, in Japanese Patent Publication Open to Public Inspection (hereinafter referred to as Japanese Patent O.P.I. Publication) No. 3-16174/1991 is disclosed a developer which does not substantially contain an aldehyde hardener such as glutaraldehyde.

However, when the film in a sheet form for X ray use is processed with developer not containing glutaraldehyde, the film slips in the developer tank, resulting in poor transportability. It has been proved that this is because the film surface is likely to slip due to the loss of the hardening reaction of glutaraldehyde.

Accordingly, a silver halide photographic light-sensitive material is strongly demanded which is free from deteriorating transportability at rapid processing, has high mechanical properties, and gives an image with high sharpness under favorable developing conditions.

SUMMARY OF THE INVENTION

An object of the invention is to provide a silver halide photographic light-sensitive material which, even when the material is rapidly processed at high temperature with a developer not containing a hardener and not lowering the operation atmosphere, can give an image with high sharpness without deteriorating transportability of the material.

DETAILED DESCRIPTION OF THE INVENTION

The above object was attained by the following invention:

That is; a silver halide photographic light-sensitive material in sheet form comprising a support having has a thickness of 70 to 120 μm and Young's Modulus of not less than 550 kg/mm$^2$ and at least one silver halide emulsion layer on at least one side of the support, wherein, when the material is developed with a developer which does not substantially contain a hardener, the material comprises a hydrophilic colloid layer having a swelling degree of not more than 80% in the developer.

The invention will be described in detail below.

For the support of the invention having has a thickness of 70 to 120 μm and Young's modulus of not less than 550 kg/mm$^2$, a support prepared from polyethylene-2,6-naphthalate attains the object of the invention.

Polyethylene-2,6-naphthalate according to the invention means a polymer comprised of ethylene-2,6-naphthalate unit, and also means polyethylene-2,6-naphthalate modified by the third component in a small amount, for example, containing the component in an amount of not more than 10 mol% and preferably not more than 5 mol%.

Polyethylene-2,6-naphthalate is prepared by polycondensation of naphthalene-2.6-dicarboxylic acid or its derivative, for example, naphthalene-2.6-dicarboxylic acid methyl ester and ethylene glycol in the presence of a catalyst and under a proper reaction condition. The third component includes a dicarboxylic acid such as adipic acid, oxalic acid, isophthalic acid, telephthalic acid, naphthalene-2.7-dicarboxylic acid or diphenylether dicarboxylic acid or its lower alkyl ester, a carboxylic acid such as p-oxybenzoic acid or p-ethoxybenzoic acid or its lower alkyl ester, a divalent alcohol such as propylene glycol, trimethylene glycol, tetramethylene glycol, pentamethylene glycol, hexamethylene glycol or diethylene glycol or a polyalkylene glycol such as polyethylene glycol or polytetramethylene glycol.

The lubricant agent such as titanium dioxide, a stabilizing agent such as phosphoric acid, phosphorous acid or its ester salt, antioxidant such as a hindered phenol, polymerization regulator or a plasticizer may be incorporated on polymerization.

The polyethylenenaphthalate used in the invention has an intrinsic viscosity of not less than 0.4 and preferably 0.55 to 0.9, since the lower polymerization degree deteriorates the mechanical stability. The number average molecular weight of polyethylenenaphthalate is not less than 10,000 and more preferably 10,000 to 50,000. The polyethylenenaphthalate has preferably a crystallinity of 35 to 60% for dimensional stability.

Crystallinity of the invention is measured by the following method:

A film is placed in a density slope tube (containing n-heptane and carbon tetrachloride) at 25°±0.5° C. for 24 hours. Then, the graduation of the film and the situation of the standard ball are read and the calibration curve is obtained thereby. Density ρ (g/cm$^3$) is found from the calibration curve and crystallinity of the film is calculated by the following equation:

$$\text{Crystallinity } (\%) = (\rho - \rho_a) \times 100 / (\rho_c - \rho_a)$$

Wherein $\rho_c$ represents a density of complete crystal and $\rho_a$ represents a density of incomplete crystal.

The polyethylene-2,6-naphthalate film used in the invention has preferably a surface specific resistivity of not more than $10^{14}$ Ω.cm, since dust adherence to the surface lowers the commercial value. As a method for preparing such a film, there is used a method for coating an antistatic agent, forming a thin layer comprising metals or metal oxides on the surface, incorporating an antistatic agent on polymerizing of raw materials, or mixing the polyester with an antistatic agent on producing the film. There may be used a polyethylene-2,6-naphthalene prepared by polycondensing in the presence of sodium alkylbenzenesulfonate and polyalkylene glycol.

The support of the invention having has, has a thickness of 70 to 120 μm, and preferably 70 to 100 μm. The thickness of the invention is measured through a contact type thickness meter produced by Anritsu Co. Ltd. The support of the invention has Young's modulus (modulus of elasticity in tension) of not less than 550 kg/mm$^2$ and preferably, 550 to 800 kg/mm$^2$.

In order to improve an adhesion to a coating layer, the surface of the support of the invention may be provided with a subbing layer, or subjected to corona charge treatment or ultra-violet exposure treatment.

The silver halide photographic light-sensitive material in sheet form according to the invention means a photographic film in sheet form comprising a support of the above described polyethylene-2,6-naphthalene, and concretely, a photographic film having an area of 6.5×8.5 to 14×17 inch$^2$.

The object of the-invention can be attained by a silver halide photographic light-sensitive material in sheet form comprising the above described support, wherein, when the material is developed with a developer which does not substantially contain a hardener, the material comprises a hydrophilic colloid layer having a swelling degree in the developer of not more than 80% and preferably 50 to 80%.

The above described developer which does not substantially contain a hardener refers to as a developing solution, a developing replenisher or a starter solution, each of which is not used to process light-sensitive materials and contains no hardener. Accordingly, the developer in which the hardener contained in the light-sensitive materials is dissolved and incorporated is outside the scope of the invention.

The hydrophilic colloid layer in the invention refers to all hydrophilic layers in the photographic component layer of the photographic light-sensitive material such as a silver halide emulsion layer, a protective layer, an intermediate layer, an antihalation layer, a filter layer or an antistatic layer.

The silver halide photographic light-sensitive material of the invention may contain a hardener in the hydrophilic colloid layer in order to obtain the degree of swelling above described. The degree of swelling of the invention of the hydrophilic colloid layer may be obtained to adjusting the amount or the kinds of a hardener to be used. The hardener to be used is not limited, and the well known hardener can be used by means of well known methods.

The hardener used in the invention include aldehydes such as formaldehyde and glutaraldehyde, the reactive halogen containing compounds disclosed in U.S. Pat. No.3,288,775 and Japanese Patent Examined Publication No. 6-12408/1994, the reactive ethylenically unsaturated compounds disclosed in US Pat. No. 3,642,486 and Japanese Patent Examined Publication No. 49-13563/1974, aziridine compounds disclosed in U.S. Pat. No. 3,017,280, epoxy compounds disclosed in U.S. Pat. No. 3,091,537, compounds disclosed in U.S. Pat. No.3,017,280, vinylsulfone compounds disclosed in Japanese Patent OPI Publication No. 5-53236/1993, reactive halogen containing hardeners disclosed in Japanese Patent OPI Publication No. 2-287345/1990, halogen carboxyl aldehydes such as mucochloric acid, dioxanes such as dihysroxydioxanes and dichlorodioxanes and inorganic hardeners such as chromium alum and zirconium sulfate. Of these hardeners, the aldehyde compounds is preferred.

The content of the hardener in the hydrophilic colloid layer on the same side of the support is preferably $1\times10^{-3}$ to 1.0 g and more preferably, $5\times10^{-3}$ to 0.5 g per g of gelatin.

The degree of swelling is measured by the following method: The layers on one side of the support of the film was removed by Heiter (trade name) produced by Kao Co. Ltd., and the measurement was conducted.

$$\text{Degree of swelling}=(B-A)\times100/A$$

In the Equation, A represents a thickness μm in dry state of the hydrophilic colloid layer which is measured through swelling degree meter produced by Shinkodenshi Co.) and B represents a thickness μm of the hydrophilic colloid layer after immersed in developer (b) at 35° C. which is measured through the above meter. The developer (b) is shown below.

| Developer (b) | |
|---|---|
| Potassium sulfite | 70 g |
| Trisodiumhydroxyethylethylenediaminetriacetate | 8 g |
| Hydroquinone | 28 g |
| Boric acid | 10 g |
| 5-methylbenzotriazole | 0.04 g |
| 1-phenyl-5-mercaptotetrazole | 0.01 g |
| Sodiummetabisulfite | 5 g |
| Glacial acetic acid (90%) | 13 g |
| Triethyleneglycol | 15 g |
| 1-phenyl-3-pyrazolidone | 1.2 g |
| 5-nitroindazole | 0.2 g |
| Potassium bromide | 4 g |
| 5-nitrobenzoimidazole | 1 g |
| N-acetyl-D,L-penicillamine | 0.1 g |

Made up to 1000 ml by adding water and adjusted to a pH of 10.5 (25° C.) using a sodium hydroxide solution.

When the film is rapidly processed with a developer in an automatic processor which does not substantially contain a hardener in the invention, the line speed is not less than 6 cm/second, and preferably 6 to 9 cm/second. The temperature of the developer is 25° to 45° C., and preferably 30° to 40° C.

The silver halide emulsions used in the invention containing silver halide grains may be those containing silver bromide, silver iodobromide or silver iodochlorobromide containing a small amount of silver chloride. The silver halide grains may be any single crystal form such as cubes, octahedrons or tetradecahedrons or multi-twins.

Emulsions used in the silver halide light-sensitive material of the invention can be produced by conventional method. For example, these can be prepared in the procedures described in "Emulsion Preparation and Types" on pages 22–23 of Research Disclosure (RD)

No.17643 (December, 1978) and on page 648 of RD No. 186716 (November, 1979).

Emulsions used in the silver halide light-sensitive material of the invention can also be prepared according to the methods described, for example, in "The Theory of the Photographic Process" by T. H. James, 4th Ed., MaCmillan Publishing Co.(1977), pp. 38–104, "Photographic Emulsion Chemistry" by G. F. Dauffin, Focal Press Co. (1966), "Chimie et Physique Photographique" by P. Glafkides, Paul Montel Co. (1967) and "Making and Coating Photographic Emulsion" by V. L. Zelikman et al., Focal Press Co. (1964).

That is, these emulsions can be prepared, under solution conditions such as the neutral method, acid method, ammoniacal method, by combining mixing conditions such as the single-jet method, double-jet method, control double-jet method with grain preparing conditions such as the conversion method, core/-shell method.

The emulsion of the silver halide photographic light sensitive material used in the invention includes, as an example, a monodispersion emulsion in which silver iodide is localized in the inner part of the grains. The "monodispersion" used in the invention is silver halide grains in which 95% by grain number or by weight of the grains is within ±40%, and preferably ±30% of the average particle diameter, when the average particle diameter is measured by an ordinary method.

The particle diameter distribution of silver halide grains may be monodispersion emulsion having a narrow distribution and multidispersion having a broad distribution. The silver halide grains may be different from the inner part to the outer part in silver halide composition. Preferred is a monodispersed emulsion comprising core/shell type double-layered grains having a high iodide content core and a low iodide content shell.

Such monodispersed emulsions can be prepared by known methods described, for example, in J. Phot. Sci., 12, pp. 242–251 (1963), Japanese Pat. O.P.I. Pub. Nos. 36890/1973, 16364/1977, 142329/1980, 49938/1983, British Pat. No. 1,413,748 and U.S. Pat. Nos. 3,574,628, 3,655,394.

The emulsion used in the light-sensitive material of the invention may be one comprising grains grown from seed grains by supplying silver ions and halide ions to the seed grains used as nucleus for growth in order to obtain he above monodispersed emulsions.

The method for preparing core/shell emulsions are well-known and is described, for example, in J. Phot. Sci., 24, pp. 198(1976), U.S. Pat. Nos. 2,592,250, 3,505,068, 4,210,450 and 4,444,877 and Japanese Pat. O.P.I. Pub. No. 143331/1985.

The silver halide emulsion used in the invention is preferably one containing tabular grains having an aspect ratio of less than 5. Such tabular grains can be improved in spectral sensitizing effect or graininess and sharpness of images and are disclosed in British Pat. No. 2,112,157, U.S. Pat. Nos.4,439,520, 4,433,048, 4,414,310, and 4,434,226, Japanese Pat. O.P.I. Pub. Nos. 113927/1983, 127921/1983, 138342/1988, 284272/1988 and 305343/1988. The emulsion can be prepared by the methods disclosed in these references.

These emulsions may use, in the process of physical ripening or grain preparation, cadmium salts, lead salts, zinc salts, thallium salts, iridium salts or its complex salts, rhodium salts or its complex salts or iron salts or its complex salts. The emulsions may be subjected to washing treatment such as noodle-washing or flocculation to remove soluble salts. Preferred desalting methods are, for example, that which uses a sulfo-group-containing, aromatic hydrocarbon-type aldehyde resin disclosed in Japanese Pat. Exam. Pub. No. 16086/1960, and that which uses high-molecular flocculant G3 or G8 exemplified in Japanese Pat. O.P.I. Pub. No. 158644/1988.

During physical ripening, or before or after chemical ripening, various photographic additives may be added to emulsions used in the invention. Usable conventional additives can be seen, for example, in Research Disclosure Nos. 17643 (December, 1978), 18716 (November, 1979) and 308119 (December, 1989). The following are relevant compounds and locations of description thereof in the above numbers of Research Disclosure.

| Additive | RD-17643 | | RD-18716 | | RD-308119 | |
|---|---|---|---|---|---|---|
| — | Page | Class | Page | Class | Page | Class |
| Chemical sensitizer | 23 | III | 648 upper right | — | 996 | III |
| Developing | 29 | XXI | 648 upper right | — | — | — |
| accelerator | 24 | IV | 649 upper right | — | 1006-7 | VI |
| Antifoggant stabilizer | | | | | | |
| Whitening agent | 24 | V | — | — | 998 | V |
| Hardener | 26 | X | 651 left | — | 1004–5 | X |
| Surfactant | 26–7 | XI | 650 right | — | 1005–6 | XI |
| Antistatic agent | 27 | XII | 645 right | — | 1006–7 | XIII |
| Plasticizer | 27 | XII | 650 right | — | 1006 | XII |
| Lubricant | 27 | XII | — | — | — | — |
| Matting agent | 28 | XVI | 650 right | — | 1008–9 | XVI |
| Binder | 26 | XXII | — | — | 1003–4 | IX |
| Support | 28 | XVII | — | — | 1009 | XVII |

The light sensitive material of the invention may be processed, for example, through processing solutions described on pages 29 and 30 of XX and XXI of the above RD-17643 or on pages 1011 and 1012 of XX and XXI of the above RD-308119.

As a developing agent of a black and white light sensitive material, dihydroxy benzenes (for example, hydroquinone), 3-pyrazolidones (for example, 1-phenyl-3-pyrazolidone) or aminophenols (for example, N-methyl-p-aminophenol) may be used singly or in combination. The developer optionally contains a preservative, an alkali agent, a pH buffer, an antifoggant, a development accelerator, a surfactant, an anti-foaming agent, a tone modifier, a water softener, a dissolution accelerator or a viscosity increasing agent. However, the developer contains no hardener. The fixing solution contains a fixing agent such as a thiosulfonate salt or a thiocyanate salt, and may contain a hardener, a water soluble aluminium salt such as aluminium sulfate or potash alum. The fixing solution may contain a preservative, a pH adjusting agent or a water softener.

EXAMPLES

The present invention will be explained referring to examples later, however, the invention is not limited thereto.

Example 1

Highly monodispersed seed emulsion T-1 was prepared by the following method.

(Preparation of T-1)

| | | |
|---|---|---|
| $A_1$ | Ossein gelatin subjected to hydrogen peroxide treatment | 150 g |
| | Potassium bromide | 60 g |
| | Made up to 1000 ml by adding water. | |
| $B_1$ | Silver nitrate | 1.5 kg |
| | Made up to 1000 ml by adding water. | |
| $C_1$ | Ossein gelatin subjected to hydrogen peroxide treatment | 40 g |
| | Potassium bromide | 1050 g |
| | Made up to 1000 ml by adding water. | |
| $D_1$ | Ammonia water (28%) | 117.5 ml |

Solutions $B_1$ and $C_1$ were added to solution $A_1$ under vigorous stirring at 40° C. by a double-jet method to produce a nucleus. After the addition, 300 cc of water was added to the resulting solution. The resulting mixture was cooled to 20° C., adjusted to a of 40 mv, and then solution $D_1$ was added thereto in 20 seconds and ripened for 5 minutes.

After that, the solution was adjusted to a pH of 6.0, and desalted using a solution containing sodium naphthalene-sulfonate-formaldehyde resin and magnesium sulfate. This seed emulsion was observed through an electron microscope and an emulsion of monodispersed silver bromide grains having an average grain diameter of 0.25 μm and a grain distribution of 30%. This emulsion was designated to be seed emulsion T-1.

(Preparation of tabular grain emulsion)

| | | |
|---|---|---|
| $E_1$ | Ossein gelatin subjected to hydrogen peroxide treatment | 37 g |
| | 10% methanol solution of polypropyleneoxy-polyethyleneoxy-disuccinate-disodium salt | 10 ml |
| | the above seed emulsion T-1 | amount equivalent to 1.14 mol of silver |
| | Made up to 4000 ml by adding water. | |
| $F_1$ | Ossein gelatin | 20 g |
| | Potassium bromide | 151 g |
| | Potassium iodide | 23 g |
| | Made up to 1103 ml by adding water. | |
| $G_1$ | Ossein gelatin | 96.5 g |
| | Potassium bromide | 624 g |
| | Made up to 4096 ml by adding water. | |
| $H_1$ | Silver nitrate | 1132 g |
| | Made up to 6248 ml by adding water. | |
| $C_1$ | Ossein gelatin subjected to hydrogen peroxide treatment | 40 g |
| | Potassium bromide | 1050 g |
| | Made up to 1000 ml by adding water. | |
| $D_1$ | Ammonia water (28%) | 117.5 ml |

Solutions $F_1$ and $H_1$ were added to solution $E_1$ under vigorous stirring at 75° C. by a double-jet method while the pH was kept at 6.5. After the addition, 300 cc of water was added to the resulting solution. The resulting mixture was cooled to 20° C., adjusted to a of 40 mv, and then solution $D_1$was added thereto in 20 seconds and ripened for 5 minutes.

After that, the solution was adjusted to a pH of 6.0, and spectral sensitizing dye, 5,5'-dichloro-9-ethyl-3,3'-di-(3sulfopropyl) oxycarbocyanine sodium salt anhydride (sensitizing dye A) was added thereto in an amount of 300 mg per mol of silver and was sufficiently adsorbed on grains. Then, the resulting mixture was desalted in the same manner as in the above seed emulsion. The emulsion has a pAg of 9.0 and a pH of 5.85 at 40° C. This emulsion was observed through an electron microscope and an emulsion of tabular silver halide grains having an average grain diameter of 0.85 μm, a grain distribution of 20%, an aspect ratio of 2.4 and an average grain thickness of 0.12μm.

This emulsion thus obtained by using seed emulsion T-1 was designated to be emulsion Em-1.

To the above obtained emulsion Em-1 were added 150 mg per mol of silver halide of the above[sensitizing dye (A) and 15 mg per mol of silver halide of 5,5'-di-(butoxycarbonyl)-1,1'-diethyl-3,3'-di-(4-sulfobutyl) benzimidazolocarbocyanine sodium salt (sensitizing dye (B)) before addition of a chemical sensitizer comprised of hypo and chloroauric acid. Chemical ripening was conducted, and stopped adding 300 mg per mol of silver halide of potassium! iodide thereto. To the resulting emulsion was added 2.5 g per mol of silver halide of 4-hydroxy-6-methyl-1,3,3a,7-tetrazaindene as a stabilizer.

The following additives were added to the emulsion after chemical ripening to prepare a coating solution.

To the above emulsion were added to the following additives to prepare a coating emulsion. The amount is per mol of silver halide.

| | |
|---|---|
| t-Butylcatechol | 400 mg |
| Copolystyrene-maleic anhydride | 2.5 g |
| Nitrophenyltriphenylphosphoniumchloride | 50 mg |
| Ammonium 1,3-dihydroxybenzene-4-sulfate | 4 g |
| $n\text{-}C_4H_9OCH_2(OH)CH_2N(CH_2COOH)_2$ | 1 g |
| 1,1-dimethylol-1-bromo-1-nitromethane | 20 mg |
| 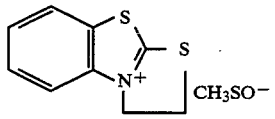 | 70 mg |
| 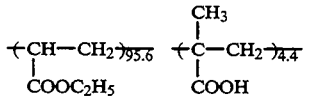 (MW: 20,000) | 25 g |

Further, the following additives were added to gelatin in the following amount per g of gelatin to prepare a protective layer solution for a protective layer.

| | |
|---|---|
| Matting agent comprised of polymethylmethacrylate having an average particle diameter of 5 μm | 40 mg |
| Colloidal silica having an average particle diameter of 0.013 μm | shown in Table 1 |
| Glyoxal | 25 mg |
| 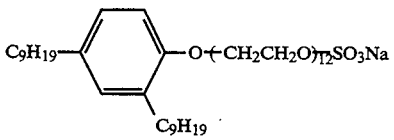 | 25 mg |
| 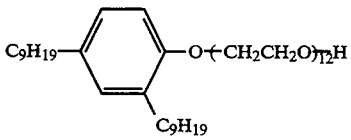 | 6 mg |
| 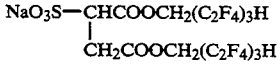 | 5 mg |

-continued

| | |
|---|---|
| $NaO_3S-CH(CH_2COO(CH_2)_2CH(CH_3)_2)-CH_2COO(CH_2)_9CH_3$ | 7 mg |
| $C_{11}H_{23}CONH(CH_2CH_2O)_5H$ | 40 mg |
| $C_9F_{19}O(CH_{12}CH_2O)_{11}H$ | 3 mg |
| Water | 15 cc |

The above obtained coating solutions were uniformly coated on both side of the support as shown in Table 1. The support has an area of 10×12 inch$^2$. That is; the both side of the support was simultaneously! coated with an emulsion layer to have a silver content of 2.1 g/m$^2$ and a gelatin content of 2.4 g/m$^2$ in one side of the support, and with a protective layer to have a gelatin content of 0.9 g/m$^2$ in one side of the support.

The above obtained sample was tested using the developer of the invention (b) and comparative developer (a). The composition of the developers and the process were shown below.

| Developer (a) | |
|---|---|
| Potassium sulfite | 70 g |
| Trisodiumhydroxyethylethylenediaminetriacetate | 8 g |
| Hydroquinone | 28 g |
| Boric acid | 10 g |
| 5-methylbenzotriazole | 0.04 g |
| 1-phenyl-5-mercaptotetrazole | 0.01 g |
| Sodiummetabisulfite | 5 g |
| Acetic acid (90%) | 13 g |
| Triethyleneglycol | 15 g |
| 1-phenyl-3-pyrazolidone | 1.2 g |
| 5-nitroindazole | 0.2 g |
| Glutaraldehyde | 4 g |
| Potassium bromide | 4 g |
| 5-nitrobenzoimidazole | 1 g |

Made up to 1000 ml by adding water and adjusted to a pH of 10.5 (25° C.) using a sodium hydroxide solution.

| Developer (b) | |
|---|---|
| Potassium sulfite | 70 g |
| Trisodiumhydroxyethylethylenediaminetriacetate | 8 g |
| Hydroquinone | 28 g |
| Boric acid | 10 g |
| 5-methylbenzotriazole | 0.04 g |
| 1-phenyl-5-mercaptotetrazole | 0.01 g |
| Sodiummetabisulfite | 5 g |
| Glacial acetic acid (90%) | 13 g |
| Triethyleneglycol | 15 g |
| 1-phenyl-3-pyrazolidone | 1.2 g |
| 5-nitroindazole | 0.2 g |
| Potassium bromide | 4 g |
| 5-nitrobenzoimidazole | 1 g |
| N-acetyl-D,L-penicillamine | 0.1 g |

Made up to 1000 ml by adding water and adjusted to a pH of 10.5 (25° C.) using a sodium hydroxide solution.

| Starter solution | |
|---|---|
| Potassium bromide | 300 g |
| Acetic acid | 144 g |
| Made up to 1 liter by adding water. | |
| Fixing solution composition | |
| Sodium thiosulfate penta hydrate | 4.5 g |
| Disodium ethylenediaminetetraacetate dihydrate | 0.5 g |
| Ammonium thiosulfate | 150 g |
| Anhydrous sodium sulfite | 8 g |

-continued

| Starter solution | |
|---|---|
| Potassium acetate | 16 g |
| Aluminium sulfate decyl-octadecyl hydrate | 10 g |
| Surfuric acid (50 wt %) | 5 g |
| Citric acid | 1 g |
| Boric acid | 7 g |
| Glacial acetic acid | 5 g |

Made up to 1 liter by adding water and adjusted to a pH of 4.2 (25° C.) using glacial acetic acid.

The starter solution and the fixing solution were used in common to developers (a) and (b).

| Step | Processing condition Temperature(°C.) | Replenishing amount |
|---|---|---|
| Introducing | | |
| Developing + cross-over | 35 | 270 ml/m$^2$ |
| Fixing + cross-over | 33 | 430 ml/m$^2$ |
| Washing + cross-over | 18 | 7 liters/minutes |
| Squeezing | | |
| Drying | | |

The automatic processor used has a developing tank content of 16 liters, a fixing tank of 10 liters and a washing tank content of 10 liter, and a pouch made of 20 mesh polyethylene was filled with 200 g of clinker 205 (composition: $SiO_2$, $Al_2O_3$, Ag+ion ceramic, particle size:1.0–1.5 mm, specific gravity:2.5–2.6, produced by Nichihankenkyusho Production and Sales Co.) and it was placed in the vicinity of the washing water supplying section of the washing tank. The drying was conducted using a combination of an infrared heater(heater temperature 220° C.) and a hot air (60° C.).

Evaluation of sharpnags

The image obtained by developing using developer (b) was evaluated by means of the following five criterions. X-ray test chart Type No. NR20012 was used.

A: A maximum of 10 LP/mm was discriminated with a magnifying glass.

B: A maximum of 8LP/mm was discriminated with a magnifying glass.

C: A maximum of 6 LP/mm was discriminated with a magnifying glass,

D: A maximum of 5 LP/mm was discriminated with a magnifying glass,

E: A maximum of 4 LP/mm was discriminated with a magnifying glass,

A is most excellent and E is least excellent in sharpness,

A transport test was carried out using the above developer (35° C.) and automatic processor SRX-503 (produced by Konica Corporation), That is; the time required from the time when the first edge of the film material was introduced in the automatic processor to the time when the same edge passed through the developing tank and the crossover between the developing tank and the fixing tank was measured with a stopwatch. The time takes longer if transporting problems occur in the developing tank, Evaluation of odor of the developer Developers (a) and (b) were placed in a beaker and the odor was evaluated by the following four criterions, A: No detectable odor, B: Slight odor, C: Definite odor, D: Extreme odor, Degree of swelling The degree of swelling was measured through the above described Equation. The lower the value, the less the swelling.

The results are shown in the following Table.

In the Table, PET represents a polyethylene terephthalate base, a comparative support, PEN a base of polyethylene-2,6-naphthalate having an intrinsic viscosity of 0.3, and PEN a polyethylene-2,6-naphthalate base, the inventive support. The thickness and. Young's modulus of each support are also shown in Table 1. GA in the "developer" column represents a hardener, glutaraldehyde.

-continued

| Developer (b) | |
|---|---|
| Triethyleneglycol | 15 g |
| 1-phenyl-3-pyrazolidone | 1.2 g |
| 5-nitroindazole | 0.2 g |
| Potassium bromide | 4 g |
| 5-nitrobenzoimidazole | 1 g |
| N-acetyl-D,L-penicillamine | 0.1 g |

Made up to 1000 ml by adding water and adjusted to a pH of 10.5 (25° C.) using a sodium hydroxide solution.

2. The material of claim 1, wherein said support is composed of polyethylene-2,6-naphthalate.

TABLE 1

| Sample No. | Protective layer Glyoxal content (g/g of gelatin) | Support Kinds | Support Thickness (μm) | Support Young's modulus (kg/mm²) | Developer Kinds | Developer GA | Line speed of automatic processor (cm/second) | Degree of swelling (%) | Sharpness | Odor | Transportability (second) |
|---|---|---|---|---|---|---|---|---|---|---|---|
| 1 (Comp.) | 0.001 | PET | 180 | 500 | a | present | 6 | 100 | E | D | 13.6 |
| 2 (Comp.) | 0.001 | PET | 180 | 500 | b | none | 6 | 100 | E | A | 14.0 |
| 3 (Comp.) | 0.9 | PEN | 180 | 650 | b | none | 6 | 70 | E | A | 13.6 |
| 4 (Comp.) | 0.001 | PET | 110 | 500 | b | none | 6 | 100 | B | A | 15.9 |
| 5 (Comp. | 0.001 | PEN | 110 | 650 | a | present | 6 | 100 | B | D | 15.3 |
| 6 (Comp. | 0.001 | PEN | 110 | 650 | b | none | 6 | 100 | B | A | 15.7 |
| 7 (Comp.) | 0.01 | PEN[1] | 110 | 500 | b | none | 6 | 70 | B | A | 15.0 |
| 8 (Comp. | 0.001 | PEN[1] | 110 | 500 | b | none | 6 | 100 | B | A | 15.9 |
| 9 (Inv.) | 0.01 | PEN | 110 | 650 | b | none | 6 | 70 | B | A | 13.6 |
| 10 (Inv.) | 0.01 | PEN | 110 | 650 | b | none | 9 | 70 | B | A | 13.8 |
| 11 (Inv.) | 0.01 | PEN | 90 | 650 | b | none | 6 | 70 | A | A | 13.7 |
| 12 (Inv.) | 0.012 | PEN | 90 | 650 | b | none | 7 | 60 | A | A | 13.7 |
| 13 (Inv.) | 0.01 | PEN | 70 | 650 | b | none | 6 | 70 | A | A | 13.8 |
| 14 (Inv.) | 0.01 | PEN | 90 | 750 | b | none | 6 | 70 | A | A | 13.6 |

Inv.: Invention
Comp.: Comparative

As is apparent from Table 1, the present invention provides a silver halide photographic light-sensitive material which, even when the material is processed with a developer which does containing a hardener and is odorless, can give an image with high sharpness without deteriorating transportability of the material.

What is claimed is:

1. A silver halide photographic light-sensitive material comprising a support having a thickness of 70 to 120 μm and Young's modulus of not less than 550 kg/mm² and provided thereon, a hydrophilic colloid layer comprising a silver halide emulsion layer, wherein said hydrophilic colloid layer has a degree of swelling of not more than 80%, the degree of swelling being obtained by the following equation:

$$\text{Degree of swelling} = (B - A) \times 100/A$$

wherein A represents a dry thickness μm of the hydrophilic colloid layer and B represents a thickness μm of the hydrophilic colloid layer after the material was immersed for 15 minutes at 35° C. in the following Developer (b):

| Developer (b) | |
|---|---|
| Potassium sulfite | 70 g |
| Trisodiumhydroxyethylethylenediaminetriacetate | 8 g |
| Hydroquinone | 28 g |
| Boric acid | 10 g |
| 5-methylbenzotriazole | 0.04 g |
| 1-phenyl-5-mercaptotetrazole | 0.01 g |
| Sodiummetabisulfite | 5 g |
| Glacial acetic acid (90%) | 13 g |

3. The material of claim 2, wherein said polyethylene-2,6-naphthalate has an intrinsic viscosity of not less than 0.4.

4. The material of claim 1, wherein said polyethylene-2,6-naphthalate has a degree of crystallinity of 35 to 60%.

5. The material of claim 1, wherein Young's modulus of said support is 550 to 800 kg/mm².

6. The material of claim 1, wherein said hydrophilic colloid layer has a degree of swelling of 50 to 80%.

7. The material of claim 1, wherein said hydrophilic colloid layer contains a hardener.

8. The material of claim 1, wherein said hardener is an aldehyde compound.

9. The material of claim 1, wherein the hardener content of said hydrophilic colloid layer on the same side of the support is $1 \times 10^{-3}$ to 1.0 g per gram of gelatin.

10. A silver halide photographic light-sensitive material comprising a support comprised of a polyethylene-2,6-naphthalate having an intrinsic viscosity of not less than 0.4 and a degree of crystallinity of 35 to 60% and provided thereon, a hydrophilic colloid layer comprising a silver halide emulsion layer, wherein said support has a thickness of 70 to 120 μm and Young's modulus of not less than 550 kg/mm², and said hydrophilic colloid layer has a degree of swelling of 50 to 80%, the degree of swelling being obtained by the following equation:

$$\text{Degree of swelling} = (B - A) \times 100/A$$

wherein A represents a dry thickness μm of the hydrophilic colloid layer and B represents a thickness μm of the hydrophilic colloid layer after the material was immersed for 15 minutes at 35° C. in the following Developer (b):

| Developer (b) | |
|---|---|
| Potassium sulfite | 70 g |
| Trisodiumhydroxyethylethylenediaminetriacetate | 8 g |
| Hydroquinone | 28 g |
| Boric acid | 10 g |
| 5-methylbenzotriazole | 0.04 g |

-continued

| Developer (b) | |
|---|---|
| 1-phenyl-5-mercaptotetrazole | 0.01 g |
| Sodiummetabisulfite | 5 g |
| Glacial acetic acid (90%) | 13 g |
| Triethyleneglycol | 15 g |
| 1-phenyl-3-pyrazolidone | 1.2 g |
| 5-nitroindazole | 0.2 g |
| Potassium bromide | 4 g |
| 5-nitrobenzoimidazole | 1 g |
| N-acetyl-D,L-penicillamine | 0.1 g |

Made up to 1000 ml by adding water and adjusted to a pH of 10.5 (25° C.) using a sodium hydroxide solution.

* * * * *